US007213494B2

(12) United States Patent
James

(10) Patent No.: US 7,213,494 B2
(45) Date of Patent: May 8, 2007

(54) BLAST PROTECTION STRUCTURES

(75) Inventor: Peter James, Gwent (GB)

(73) Assignee: Cintec International Limited, Newport (GB)

( * ) Notice: Subject to any disclaimer, the term of this patent is extended or adjusted under 35 U.S.C. 154(b) by 0 days.

(21) Appl. No.: 10/296,447

(22) PCT Filed: Mar. 11, 2002

(86) PCT No.: PCT/GB02/01103

§ 371 (c)(1),
(2), (4) Date: Jul. 25, 2003

(87) PCT Pub. No.: WO02/072981

PCT Pub. Date: Sep. 19, 2002

(65) Prior Publication Data

US 2004/0091181 A1 May 13, 2004

(30) Foreign Application Priority Data

Mar. 10, 2001 (GB) ..... 0105998.9
Jan. 19, 2002 (GB) ..... 0201195.5

(51) Int. Cl.
*F42B 33/00* (2006.01)

(52) U.S. Cl. ..... 86/50; 89/36.01; 89/36.02; 89/36.04

(58) Field of Classification Search ..... 86/50; 89/36.01, 36.02, 36.04
See application file for complete search history.

(56) References Cited

U.S. PATENT DOCUMENTS

| | | | | |
|---|---|---|---|---|
| 3,806,025 | A | 4/1974 | Marshall | |
| 4,836,079 | A * | 6/1989 | Barrett | 86/50 |
| 5,225,622 | A * | 7/1993 | Gettle et al. | 86/50 |
| 6,289,816 | B1 * | 9/2001 | Keenan et al. | 102/303 |
| 6,526,904 | B2 * | 3/2003 | Liston et al. | 114/345 |
| 6,807,891 | B2 * | 10/2004 | Fisher | 89/36.02 |

FOREIGN PATENT DOCUMENTS

| | | |
|---|---|---|
| DE | 31 12 729 | 10/1982 |
| DE | 199 45 108 | 11/2000 |
| EP | 0 276 918 | 8/1988 |
| GB | 2 314 614 | 1/1998 |
| GB | 2 326 428 | 12/1998 |
| GB | 2 335 259 | 9/1999 |
| WO | WO 95 08749 | 3/1995 |

* cited by examiner

*Primary Examiner*—J. Woodrow Eldred
(74) *Attorney, Agent, or Firm*—Young & Thompson

(57) ABSTRACT

A blast protection structure is formed of one or more bags, generally shown as (1) in FIG. 2. Such bags comprise an upper and lower compartment, with the lower compartment having a reinforcing layer (2), preferably formed of an impact reactant structure such as Kevlar®. The upper surface (3) of the upper compartment, has a non-slip coating to provide improved stacking of bags. Such bags can be used to provide blast protection structures to minimize the risk of damage from an explosion.

16 Claims, 1 Drawing Sheet

BLAST PROTECTION STRUCTURES

BACKGROUND OF THE INVENTION

This invention relates to blast protection structures and in particular to bags used to make blast protection walls and roadways.

A classic temporary blast protection wall is made of sandbags. Although sandbags are of proven value, they do have drawbacks. They are time consuming and not that easy to fill. They generally have to be filled at least a short distance away from where the wall is to be built, and hence have to be carried there after filling. Further, a suitable filling material is not always readily available, and once the need for the wall is over, emptying the bags and disposing of the filling material can be as problematic as filling them and building the wall in the first place.

An alternative that has been in more recent use, comprises tanks of water, built up like bricks. The tanks are generally of black or at least dark plastics material and are substantially rigid. They are fairly light when empty, and so courses of tanks can easily be placed one adjacent another to form a wall, and then filled in situ from a hose, using either a local water supply or a tanker. But they are bulky items to store and transport, and they cannot readily be made to nest together in a compact stack. They have to be closed vessels. Also, being opaque, they cannot be checked at a glance to see whether they are full or empty.

SUMMARY OF THE INVENTION

It is an object of the present invention to overcome, or at least ameliorate these disadvantages.

According to the present invention, there is provided a blast protection structure comprising one or more rupturable containers, each of said rupturable containers being formed of a flexible bag having a aperture and filler cap so that fluid can be introduced into the bag and sealed therein, to give substantial rigidity to said rupturable container and to provide blast protection.

It is envisaged, that the fluid may be a combination of water and air, introduced sequentially into the bag. It is preferred that the bags should be completely water filled, since if there is an explosion, the water will be a far more effective suppressant than air. However there may be occasions when water is insufficient in quantity or is even not available, but there is a compressor available.

For some purposes, the blast protection structure may have bags which are divided into internal chambers, preferably one above the other with the lowermost chamber having a reinforcement layer.

It is envisaged the bag may be divided into two chambers, with the reinforcement layer being Kevlar®.

preferably the uppermost chamber of the bag has an external non-slip coating. This coating may be integral with the material making up the bag or it may be a non-slip layer which is applied to the bag after manufacture. The non-slip coating reduces the risk of adjacent bags from moving relative to one another, so weakening the structure.

It is preferred that the flexible bags have tongues and grooves or rebates to enable adjacent flexible bags to be interlocked or to have some degree of interengagement. Further, the bags, which will generally be of already referred to reinforcement plastics material, may be fabric reinforced throughout, and they can be constructed with internal webs or ties so that when in position they approximate a solid block and not bulge excessively.

Ideally it is envisaged that the flexible bags will be formed of a drop stitch material, which comprises two parallel skins interconnected by a dense uniform "forest " of equal length filaments so that if the skins are urged apart (as when they form opposite sides of a bag filled with water) they remain flat and parallel rather than bulging. This provides a degree of uniformity at opposed faces and so allows for easier construction of the structure using the bags.

Further it is envisaged that a blast protection structure may be formed whereby the flexible bags are used in conjunction with rigid containers to provide blast protection. provision may be made for the bags to leave gaps for access by cameras or robotic arms, or even by human hands. These gaps do not have to be very large and measures can be taken to mitigate the effect of any blast escaping through them. An example of such measures could be the inclusion of meshing.

One type of blast protection structure is formed by flexible bags which are assembled in layers. It may be a simple wall, or a more complex arrangement such as a plurality of sealable bags assembled into a hood-like structure which is enlarged and stablised by the bags being filled with liquid.

Bags arranged in layers will generally be filled from the bottom layer upwards. In a simple form, a dome is created, which can be quickly assembled over a suspect package or container, for example, and when complete any explosions should be largely or even completely contained within the dome. The bags may suffer irreparable damage and the surrounding areas may be flooded in a limited way, but this is not as life threatening as an explosion. Further, the release of liquid would help to extinguish any flames or fire that is produced or suppress any smoke and it is the density of liquid that allows for such actions.

It is further envisaged that a blast protection structure may be formed by filled bags linked to one another to form a linear structure . preferably, the linear structure forms a pathway over which persons or vehicles may travel.

Such a structure may provide a temporary path or roadway for laying over hazardous ground. It comprises a plurality of sealable bags linked to be capable of being rolled out or distributed from a bundle into a interim path or roadway, this being completed by filling the bags with fluid.

Thus, when confronted with a mine field, a bundle of these bags can be unrolled in front of the user, or attached one by one in sequence to a growing path or roadway, the bags being successively filled to make them semi-rigid before any substantial weight is imposed on them. Concentrated load on the upper surface will be dissipated into a low unit area pressure on the ground and absorbed or imparted to the surrounding ground by the lower under surface. For example, a foot fall that would set off a personnel mine if there was direct contact has its effect spread so that there is not sufficient pressure on the mine, if beneath the path, for it to be detonated. On a larger scale, the wheels of a truck would not set off a vehicle mine beneath a load spreading roadway. Also, of course in the case of air-filled bags, buoyancy provided by the air-filled bags would serve better if swampy ground is to be traversed.

In building blast protection structures according to the invention, whether they be for a dome structure, wall or a linear structure forming a roadway, a course of empty bags can be laid out, filled in situ, followed by another course of empty bags and so on.

When no longer needed each bag can be emptied simply by pulling a plug, and once emptied the bags can be rolled or folded into compact form for transport and storage.

Apart from filler caps and drain plugs, there need be no rigid parts so that, in the event of a blast, there is initially no hazard from flying shards of metal or substantially rigid plastics material.

Should any bag be punctured and leak, this will be soon, if not immediately, apparent from a sag in the wall and a visible trickle or spurt of water, and remedial action can be taken.

BRIEF DESCRIPTION OF THE DRAWINGS

For a better understanding of the invention some embodiments will now be described, by way of example. With reference to the accompanying drawings, in which.

DETAILED DESCRIPTION OF THE PREFERRED EMBODIMENTS

Figure 1:
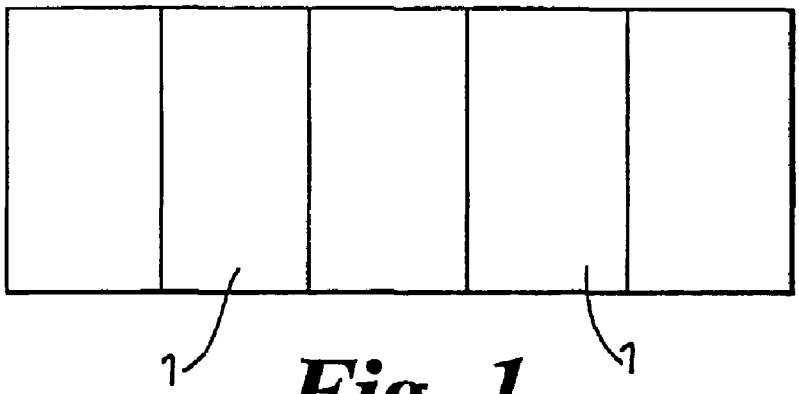
FIG. 1 is a plan view of a temporary path constructed from water-filled bags.

The path of FIG. 1 is made up from a plurality of elongate watertight bags 1, transverse to the direction of the path. When empty they can be rolled up, and when rolled out flat they can be filled with water sequentially so that each bag becomes hard, but not absolutely rigid. They are preferably made of drop-stitch material, as mentioned above, so that the path is generally flat.

Figure 2:
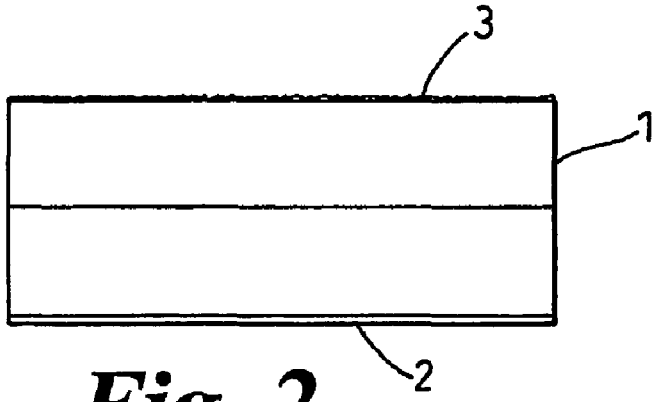
FIG. 2 is a cross-section of one such bag.

Each bag is double chambered, one above the other as shown in FIG. 2. The underside 2 is sheathed in the material known as Kevlar, as protection against rough surfaces and for blast mitigation. The upper surface 3 has a non-slip coating or layer applied to it. Typically the total depth might be of the order of 200 mm (each chamber 100 mm) and the dimension in the longitudinal direction of the path 1.45 m. The width can be selected as desired.

Figure 3:
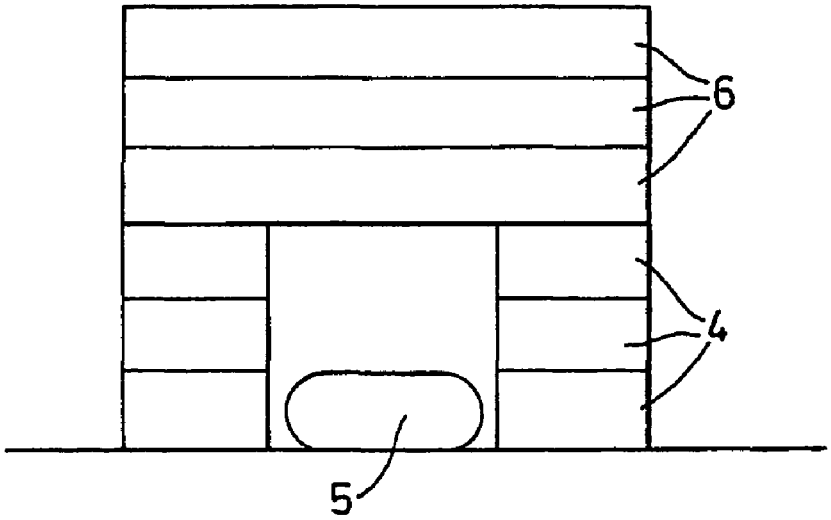
FIG. 3 is a cross-section of a protective shield.

In FIG. 3, a set of annular bags 4 can be built up into a drum-like wall to surround a device 5 that might explode. This wall is capped by several disc-like bags 6, roofing over the device 4.

In the wall construction, empty bags are placed in position before being filled and they can be constructed with internal ties so that they do not bulge, but form flat topped pillars, which can lie in stable courses, one above the other.

The bags are filled sequentially from the bottom, and when the structure is complete there is quite a mass of contained water over the device, and thick walls of compressed water bags around it. An explosion will be largely if not completely contained.

If a blast is thought to be imminent and if no protection exists, this waterbag protection can often be put in place and erected without a person approaching the blast source, such as a suspected parcel bomb. Empty pre-linked bags can be carried robotically into proximity of the blast source trailing pre-connected hoses. The bags can be filled from a distance, building up a protective structure in front of, or even around and over, the danger point.

Although the main embodiments of the invention relate to dome and roadway structures, other structures may be formed from the flexible bags such as bunkers, tunnels or reinforcing walls, placed in front of windows or doors of doorways.

The invention claimed is:

1. A ground supportable blast protection structure, comprising:

a plurality of rupturable inflatable containers defining when inflated a blast protection wall having substantially parallel opposing side wall surfaces, at least one filler aperture and a corresponding closure means permitting the containers to be filled with a liquid, wherein the opposing side wall surfaces of each of said plurality of containers are interconnected by a drop stitch material, said drop stitch material prevents or inhibits outward bulging of the side wall surfaces when the containers are filled with the liquid to thereafter retain the opposing sidewall surfaces substantially parallel to each other.

2. The structure of claim 1, wherein said walls are arranged to be substantially planar when the containers are inflated.

3. The structure of claim 1, wherein said plurality of containers are stacked in plural layers to define the blast protection wall.

4. The structure of claim 1, wherein said containers at a bottom of said structure have a bottom surface that comprises a reinforcement layer of aramid fibers.

5. The structure of claim 1, wherein said containers at a top of said structure have a top surface that comprises a non-slip coating.

6. The structure of claim 1, wherein at least one of said containers comprises two internal chambers separated from each other one above the other.

7. The structure of claim 1, wherein said containers are fillable with gas as well as liquid.

8. The structure of claim 1, wherein said containers are assembled in a dome.

9. The structure of claim 1, wherein said containers are arranged side-by-side to define a path.

10. The structure of claim 1, wherein each of said containers is releasably connected to an adjacent one of said containers.

11. A ground supportable blast protection structure, comprising:

a plurality of inflatable containers defining when inflated a blast protection wall, each of said containers having an aperture opening to an inflatable core thereof and a removably replaceable cap for sealably closing said aperture, said aperture being adapted to receive a flowable substance that inflates said core, and each of said containers having tongues and grooves that interlock with grooves and tongues of adjacent ones of said containers.

12. The structure of claim 11, wherein each of said containers has at least two opposing side walls made of a drop stitch material.

13. The structure of claim 12, wherein said at least two walls are arranged to be substantially planar when the respective one of said containers is inflated.

14. The structure of claim 11, wherein said plurality of containers are stacked in plural layers to define the blast protection structure.

15. The structure of claim 11, wherein said containers are assembled in a dome.

16. The structure of claim 11, wherein said containers are arranged side-by-side to define a path.

* * * * *